US009118144B2

(12) United States Patent
Hasse et al.

(10) Patent No.: US 9,118,144 B2
(45) Date of Patent: Aug. 25, 2015

(54) MULTI-LEVEL CONNECTOR AND USE THEREOF THAT MITIGATES DATA SIGNALING REFLECTIONS

(75) Inventors: Michael D. Hasse, Austin, TX (US); Nanju Na, Essex Junction, VT (US); Nam H. Pham, Round Rock, TX (US); Lloyd A. Walls, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 426 days.

(21) Appl. No.: 13/492,115

(22) Filed: Jun. 8, 2012

(65) Prior Publication Data

US 2013/0330940 A1 Dec. 12, 2013

(51) Int. Cl.

| | |
|---|---|
| ***H01R 12/71*** | (2011.01) |
| ***H01R 13/627*** | (2006.01) |
| ***H01R 29/00*** | (2006.01) |
| ***H01R 13/6586*** | (2011.01) |

(52) U.S. Cl.

CPC ..... *H01R 13/6273* (2013.01); *H01R 12/716* (2013.01); *H01R 13/6586* (2013.01); *H01R 29/00* (2013.01); *Y10T 29/49117* (2015.01)

(58) Field of Classification Search

USPC ..... 439/325, 327, 328, 507, 631

See application file for complete search history.

(56) References Cited

U.S. PATENT DOCUMENTS

| | | | | | |
|---|---|---|---|---|---|
| 3,701,071 | A | * | 10/1972 | Landman | 200/5 R |
| 4,142,226 | A | | 2/1979 | Mears | |
| 4,343,523 | A | | 8/1982 | Cairns et al. | |
| 4,598,966 | A | | 7/1986 | Boland | |
| 4,677,527 | A | | 6/1987 | Pasterchick, Jr. et al. | |
| 4,973,270 | A | * | 11/1990 | Billman et al. | 439/630 |
| 5,098,306 | A | | 3/1992 | Noschese et al. | |
| 5,162,002 | A | * | 11/1992 | Regnier | 439/637 |
| 5,236,372 | A | * | 8/1993 | Yunoki et al. | 439/260 |
| 5,360,346 | A | * | 11/1994 | Regnier | 439/61 |
| 5,425,651 | A | * | 6/1995 | Thrush et al. | 439/326 |
| 5,620,342 | A | * | 4/1997 | Kinross | 439/637 |
| 5,919,064 | A | * | 7/1999 | Petersen et al. | 439/637 |
| 6,149,468 | A | * | 11/2000 | Meng | 439/637 |
| 6,227,867 | B1 | * | 5/2001 | Chen et al. | 439/60 |

(Continued)

OTHER PUBLICATIONS

Hasse et al., "Multi-Level Connector and Use Thereof that Mitigates Data Signaling Reflections," U.S. Appl. No. 14/088,949, filed Nov. 25, 2013, 32 pages.

(Continued)

*Primary Examiner* — James Harvey

(74) *Attorney, Agent, or Firm* — Yee & Associates, P.C.; Parashos Kalaitzis

(57) ABSTRACT

An improved electrical connector for connecting bus lines to a card such as a memory card or media card, including a multi-level connector comprising a latching device having a plurality of insertable latch positions that advantageously allows for selectively connecting or isolating an electrical path to an adjoining connector. The connectors of unpopulated DIMM slots are disconnected from the network along with the traces that would normally form a stub with associated undesirable signal reflections that would otherwise disturb the signal transmitted to the receiving end if not properly terminated. The contacts of the edge connector itself are used as a means to selectively connect or disconnect adjacent/downstream cards in a serially cascaded architecture. The burden of the stubs due to unpopulated card slots and the need to place one card at the far end of the network are thus eliminated.

19 Claims, 15 Drawing Sheets

(56) References Cited

U.S. PATENT DOCUMENTS

| | | | | |
|---|---|---|---|---|
| 6,357,022 | B1 * | 3/2002 | Nguyen et al. | 714/42 |
| 6,361,358 | B1 * | 3/2002 | Kajinuma | 439/497 |
| 6,705,877 | B1 | 3/2004 | Li et al. | |
| 6,833,618 | B2 | 12/2004 | Ono et al. | |
| 6,997,728 | B1 * | 2/2006 | Chen | 439/260 |
| 7,276,786 | B2 | 10/2007 | Cho et al. | |
| 7,300,298 | B2 * | 11/2007 | Kameda | 439/326 |
| 7,319,304 | B2 | 1/2008 | Veloo et al. | |
| 7,501,586 | B2 | 3/2009 | Wig et al. | |
| 7,503,792 | B2 * | 3/2009 | Xiao | 439/326 |
| 7,619,490 | B2 | 11/2009 | Asano | |
| 7,771,206 | B2 | 8/2010 | Bruennert et al. | |
| 7,905,751 | B1 | 3/2011 | Davis | |
| 7,953,125 | B2 | 5/2011 | Liva et al. | |
| 8,062,071 | B2 * | 11/2011 | Yamakami et al. | 439/631 |
| 8,771,018 | B2 * | 7/2014 | McGrath | 439/630 |
| 2002/0009929 | A1 | 1/2002 | Miller et al. | |
| 2007/0243744 | A1 * | 10/2007 | Yang et al. | 439/326 |
| 2009/0007048 | A1 * | 1/2009 | Cases et al. | 716/12 |
| 2010/0062647 | A1 * | 3/2010 | Yang | 439/630 |
| 2011/0070775 | A1 | 3/2011 | Healey et al. | |
| 2011/0159718 | A1 * | 6/2011 | McKee | 439/326 |
| 2012/0034820 | A1 * | 2/2012 | Lang et al. | 439/660 |
| 2012/0252232 | A1 * | 10/2012 | Buck et al. | 439/55 |
| 2013/0330940 | A1 * | 12/2013 | Hasse et al. | 439/65 |
| 2014/0075748 | A1 * | 3/2014 | Hasse et al. | 29/825 |

OTHER PUBLICATIONS

Office Action, dated Mar. 13, 2015, regarding U.S. Appl. No. 14/088,949, 15 pages.

* cited by examiner

MULTI-LEVEL CONNECTOR AND USE THEREOF THAT MITIGATES DATA SIGNALING REFLECTIONS

BACKGROUND OF THE INVENTION

1. Field of the Invention

The disclosure relates generally to apparatus and techniques for mitigating signal reflections for signals in a data processing system, and more specifically relates to a connector and associated connector usage that mitigates signal reflections by eliminating stubs in a signal path.

2. Description of the Related Art

As processor speeds increase, there is a growing need to make improvements in the card and connector interface that connect to a plurality of cards and connects. As but one example, dual inline memory modules (DIMM) are plugged into various DIMM connectors on a system or motherboard to increase the amount of memory that is usable in a data processing system. The DIMM connectors are typically connected in a serial fashion on the system or motherboard, and introduce reflection-points or stubs in the electrical path or bus. FIG. 1A shows a traditional DIMM connector 100 without a DIMM card inserted within a cavity 115 of such DIMM connector. This DIMM connector has a plurality of attachment points 102 and 104 (only two are shown for ease in clarity) for connecting the DIMM connector 100 to a system or motherboard (not shown). The DIMM connector 100 also has a plurality of pins 106 and 108 (only two are shown for ease in clarity) for providing an electrical pathway from the attachment points 102 and 104 to a DIMM card when inserted in such DIMM connector. This connection can be seen in FIG. 1B that depicts a traditional DIMM connector 100 with a DIMM card 110 inserted therein. The pins 106 and 108 positively engage with wiring vias or connecting points (not shown) on the DIMM card 110, thereby providing an electrical connection from the DIMM card 110 to the system or motherboard by way of pins 106/108 and attachment points 102/104.

Certain connector assemblies for facilitating connection of a card or board inserted therein to a planar or motherboard also contemplate use of different lengths for the wires, strips, or wiring vias within the connector assembly to make it easier to insert and remove cards or boards. For example, as described in U.S. Pat. No. 4,095,866 entitled "High Density Printed Circuit Board and Edge Connector Assembly" which is hereby incorporated by reference as background material, two different strip lengths—a long strip length and a short strip length—are used to provide an electrical connection from the connector assembling to a card/board inserted into such connector assembly, as shown by elements 101/103 (long pins) and 105/107 (short pins) in FIG. 1C, that are part of the connector assembly 109 that is attached to a system or motherboard 111. The greater length of the spring contact members/strips reduces the force required for insertion of a card/board 113 into a cavity 115 within the connector assembly 109.

A depiction of signal paths within the system or motherboard interconnected to a DIMM card is generally shown at 200 of FIG. 2. Here, there are two DIMM connectors 100, specifically Connector 1 and Connector 2, with one (Connector 1) having a DIMM card 110 inserted therein, and the other (Connector 2) not having a DIMM card inserted therein. Only two representative bus signals 202 and 204 are shown for clarity, although in practice there are many bus signals including both address and data signals. The bus signals provide an electrical path between the system or motherboard and the memory devices. For example, Sig 1 element 202 provides an electrical path from the system/motherboard to Connector 1 through attachment point 102 and pin 106. Similarly, Sig 2 element 204 provides an electrical path from the system/motherboard to Connector 1 through attachment point 104 and pin 108. Connector 2 is arranged in a serial fashion with respect to Connector 1, and therefore Sig 1 element 202 also extends to element 102 of Connector 2 and Sig 2 element 204 also extends to element 104 of Connector 2 to provide an electrical path between the system/motherboard and Connector 2 in the event that a DIMM card were to be plugged into Connector 2 to increase memory capacity for the data processing system. Additional connectors can also be provided in this serial arrangement, and in such a case the Sig 1 element 202 and Sig 2 element 204 (as well as all other bus signals) would extend to such other connectors as indicated by the dotted lines for Sig 1 and Sig 2.

FIG. 3 provides a conceptual wiring view of series connections among multiple DIMM connectors on a system/motherboard at 300, where connector pads on the system/motherboard are shown and each path includes short or long traces and vias of the system/motherboard that provide the bus nodes to each of the connectors (not shown) mounted on the system/motherboard. When all of the connectors are not populated with a DIMM card, these wiring traces and vias present stubs 302 that act as reflection points, where the electrical signal that is activated to access a given DIMM card continues to travel along wiring traces and vias to its end, and then reflects back along the same wiring path back to the signal's originating point, as is known in the art. Current solutions to this stub-reflection problem include either providing some type of impedance-terminator at the end of the stub to absorb the electrical signal at the end of the stub, or to use the very end connector as the first DIMM card that is connected/plugged-in to reduce the length of the stub.

FIG. 4 shows at 400 a traditional DIMM connector with the numerous pins that support the numerous bus signals used to electrical interconnect with a DIMM card (not shown) when such DIMM card is inserted into the DIMM connector by using of a latching mechanism 402.

As shown above and summarized in FIG. 5, a problem exists when all card connectors are not populated with cards due to undesirable stub-reflections that adversely impact the maximum operational speed of the bus, thus negatively impacting overall system performance of a data processing system. Also note in FIG. 5 that when only one DIMM is populated in position C3 shown in the far-end configuration, stubs caused by the presence of the connector fingers of C1 and C2 will still adversely effect system performance. This technique is typically used if only one DIMM were used. However, this places the DIMM further away from the driver/receiver circuitry and forces the longest signal path and thus degrades system performance due to the longer path.

BRIEF SUMMARY OF THE INVENTION

According to one embodiment of the present invention, there is provided an improved electrical connector for connecting bus lines to a card such as a memory card or media card. In particular, an apparatus is provided that comprises a multi-level connector comprising a latching device having a plurality of insertable latch positions. The multi-level connector advantageously allows for selectively connecting or isolating an electrical path to an adjoining connector thus allowing for a single card to connect with the shortest possible path to a processor or other net driving source. The connectors of unpopulated DIMM slots are disconnected from the network along with the traces that would normally form a stub with associated undesirable signal reflections that would otherwise disturb the signal transmitted to the receiving end if not properly terminated. The contacts of the edge connector itself are used as a means to selectively connect or disconnect adjacent/downstream cards in a serially cascaded architecture. The burden of the stubs due to unpopulated card slots and the need to place one card at the far end of the network are thus eliminated.

DETAILED DESCRIPTION OF THE INVENTION

As will be appreciated by one skilled in the art, aspects of the present invention may be embodied as a system or methodology. Aspects of the present invention are described below with reference to flowchart illustrations and/or block diagrams of methods and apparatus (systems) according to embodiments of the invention.

Figure 1A:
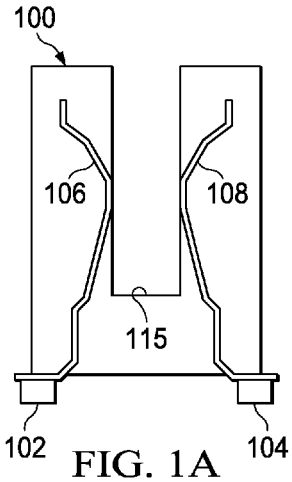
FIG. 1A (BACKGROUND ART)
FIG. 1A depicts a conventional DIMM connector without an installed card.
Figure 1B:
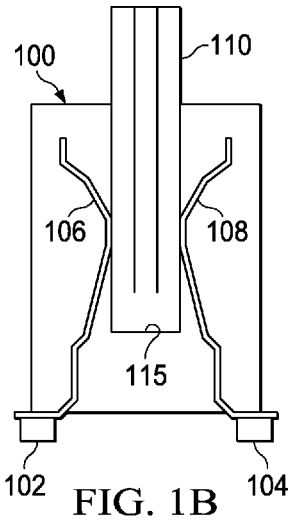
FIG. 1B (BACKGROUND ART)
FIG. 1B depicts a conventional DIMM connector with an installed DIMM card.
Figure 2:
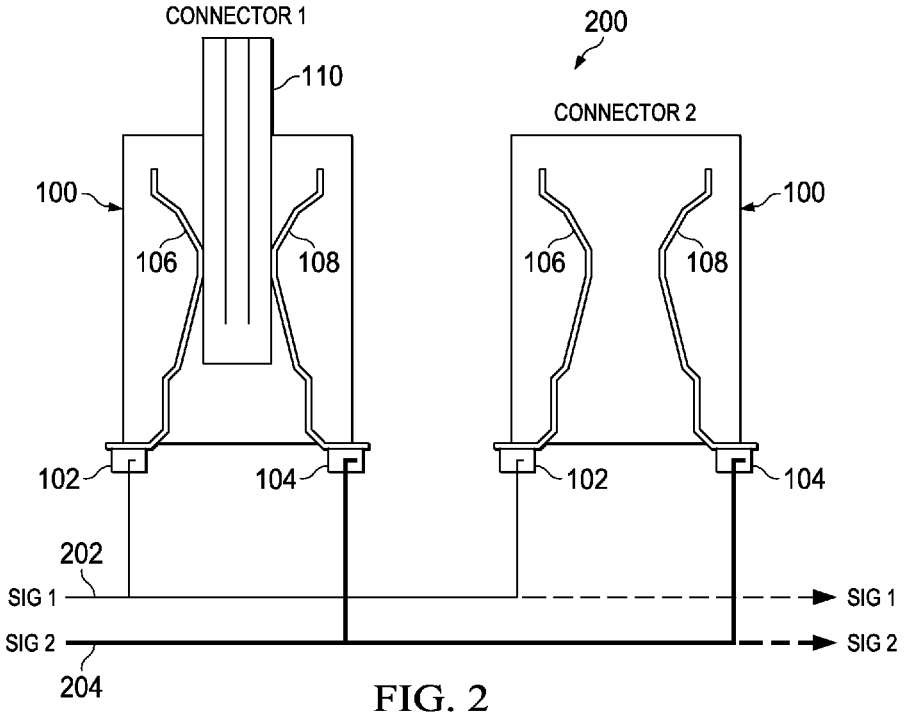
FIG. 2 depicts a conventional DIMM connectivity and routing technique.
Figure 1C:
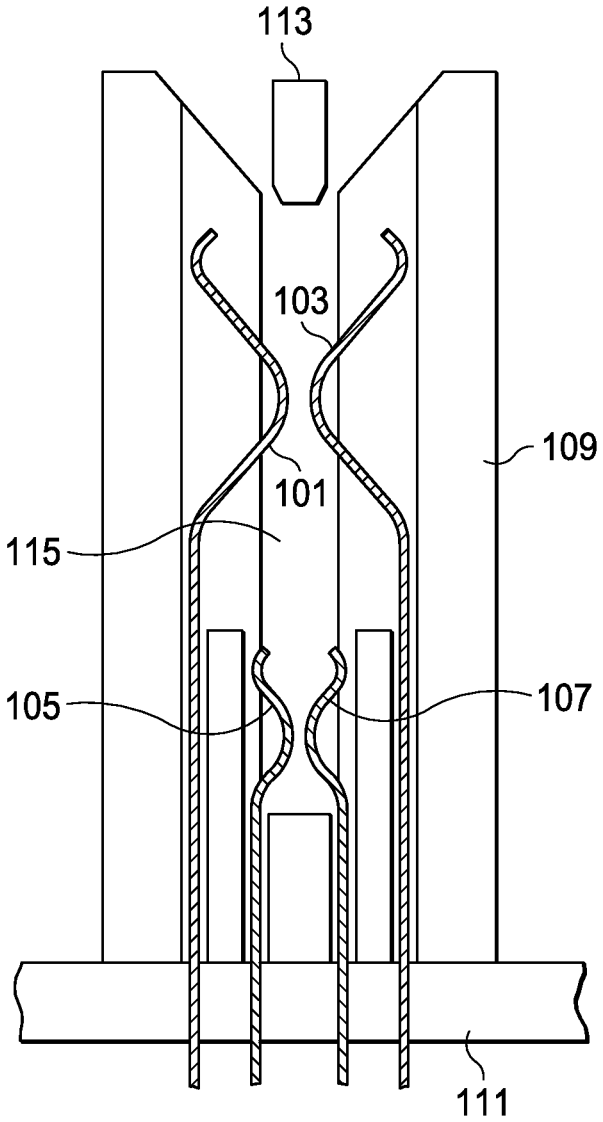
FIG. 1C (BACKGROUND ART)
FIG. 1C depicts a conventional high-capacity connector with a plurality of connections provided within such connector.
Figure 3:
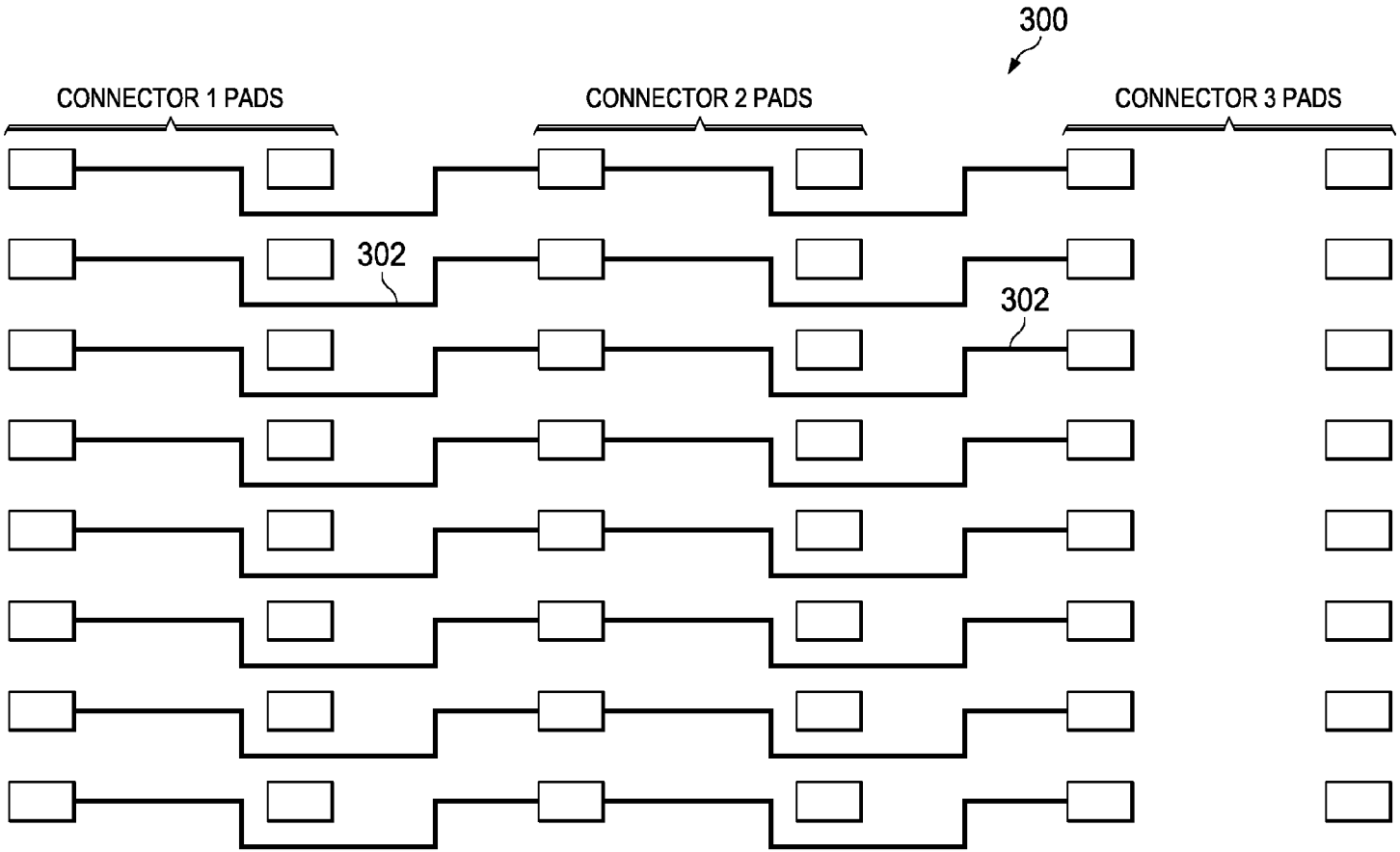
FIG. 3 depicts printed circuit board routing using convention DIMM placement.
Figure 4:
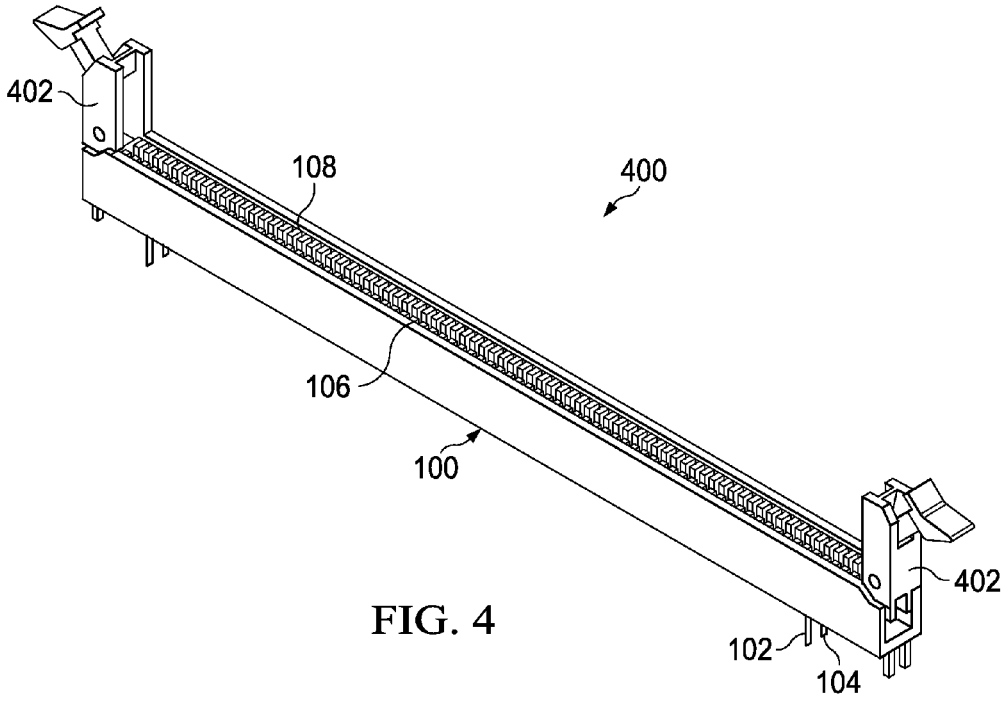
FIG. 4 depicts a card edge connector with levers that may be used with DIMM modules or cards.
Figure 5:
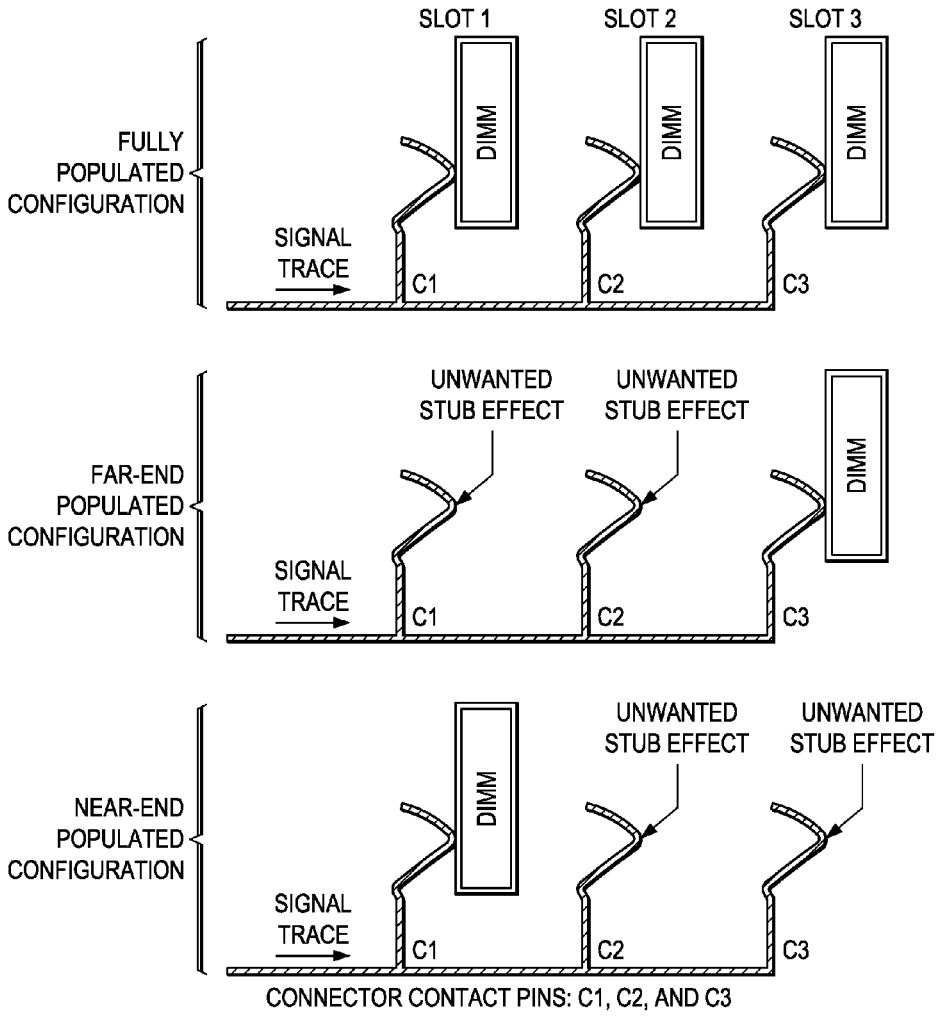
FIG. 5 depicts a serial daisy chain net topology having undesired stub effects.
Figure 6A:
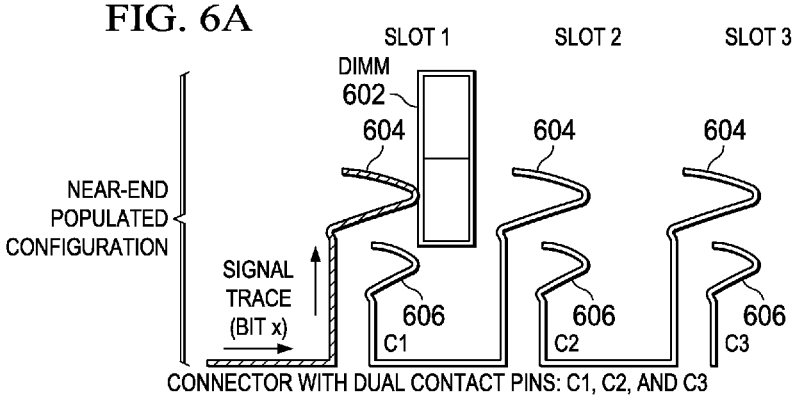
FIG. 6A depicts an embodiment with a near-end populated configuration.
Figure 6B:
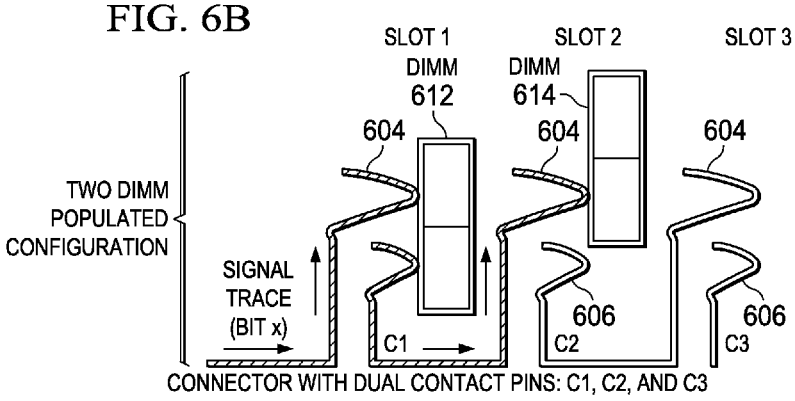
FIG. 6B depicts an embodiment with a two-DIMM populated configuration.
Figure 6C:
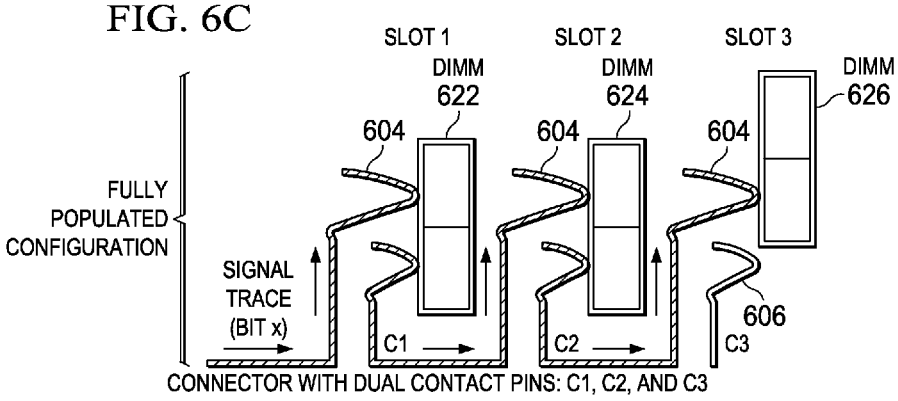
FIG. 6C depicts an embodiment with a fully populated configuration.

Referring now to FIGS. 6A, 6B, and 6C, there is shown a near-end populated configuration, a two DIMM populated configuration, and a fully populated configuration according to a preferred embodiment, respectively, that provides an improved connector with dual-contact pins C1, C2 and C3 for connecting bus lines to a card such as a memory card or media card. In particular, an apparatus is provided that comprises a multi-level connector comprising a latching device having a plurality of insertable latch positions. In a preferred embodiment, two (2) different physical levels are provided, although more are possible. When a card/module is only partially inserted in a given connector slot, that is herein called a first level, a pair of connector pins associated with a given bus signal of the connector slot and main printed circuit board are electrically isolated from one another. When a card/module is fully inserted in a given connector slot, that is herein called a second level, a pair of connector pins associated with a given bus line of the connector slot and main printed circuit board are electrically connected together by finger contacts provided on the card/module, as will now be shown in detail.

Referring specifically to FIG. 6A and the near-end populated configuration, where a DIMM module/card 602 is provided in Slot 1, the DIMM 602 is only inserted into a first level of a multi-level connector, the first level being provided at the curved portion of pin 604 of Slot 1. Since there is no electrical continuity between pin 604 of Slot 1 and pin 606 of Slot 1 when DIMM 602 is inserted in the first or top level position of Slot 1, there is no stub that would otherwise provide undesirable signal reflections. In essence, the bus wiring for Slot 2 and Slot 3 is electrically isolated from the bus wiring for Slot 1 when DIMM 602 is only inserted down into the first level of Slot 1.

Referring specifically to FIG. 6B and the two-DIMM populated configuration, where a DIMM module/card 612 is provided in Slot 1 and a DIMM module/card 614 is provided in Slot 2, the DIMM 612 is fully inserted down into a second level of a multi-level connector, the second level being provided at the curved portion of pin 606. The DIMM 614 in Slot 2 is only inserted into a first level of a multi-level connector, the first level being provided at the curved portion of pin 604 of Slot 2. Since there is no electrical continuity between pin 604 of Slot 2 and pin 606 of Slot 2 when DIMM 602 is inserted in the first or top level position of Slot 2, there is no stub that would otherwise provide undesirable signal reflections. In essence, the bus wiring for Slot 3 is electrically isolated from the bus wiring for Slot 1 and Slot 2 when DIMM 612 is fully inserted in Slot 2 and DIMM 614 is only inserted down into the first level of Slot 2.

Referring specifically to FIG. 6C and the fully populated configuration, where a DIMM module/card 622 is provided in Slot 1, a DIMM module/card 624 is provided in Slot 2 and a DIMM module/card 626 is provided in Slot 3, the DIMM 622 is fully inserted down into a second level of the multi-level connector, the second level being provided at the curved portion of pin 606 of Slot 1. The DIMM 624 in Slot 2 is fully inserted down into a second level of the multi-level connector, the second level being provided at the curved portion of pin 606 of Slot 2. The DIMM 626 in Slot 3 is only inserted into a first level of a multi-level connector, the first level being provided at the curved portion of pin 604 of Slot 3. Here, there is electrical connectivity between pin 604 of Slot 1 and pin 606 of Slot 1, as well as electrical connectivity between pin 604 of Slot 2 and pin 606 of Slot 2 that continues on to pin 604 of Slot 3. In essence, all of Slots 1-3 are electrically connected together in this fully populated configuration shown in FIG. 6C. Of course, if there were more than three (3) slots, the same techniques are applicable to slots further down the serial cascaded bus.

Figure 7A:
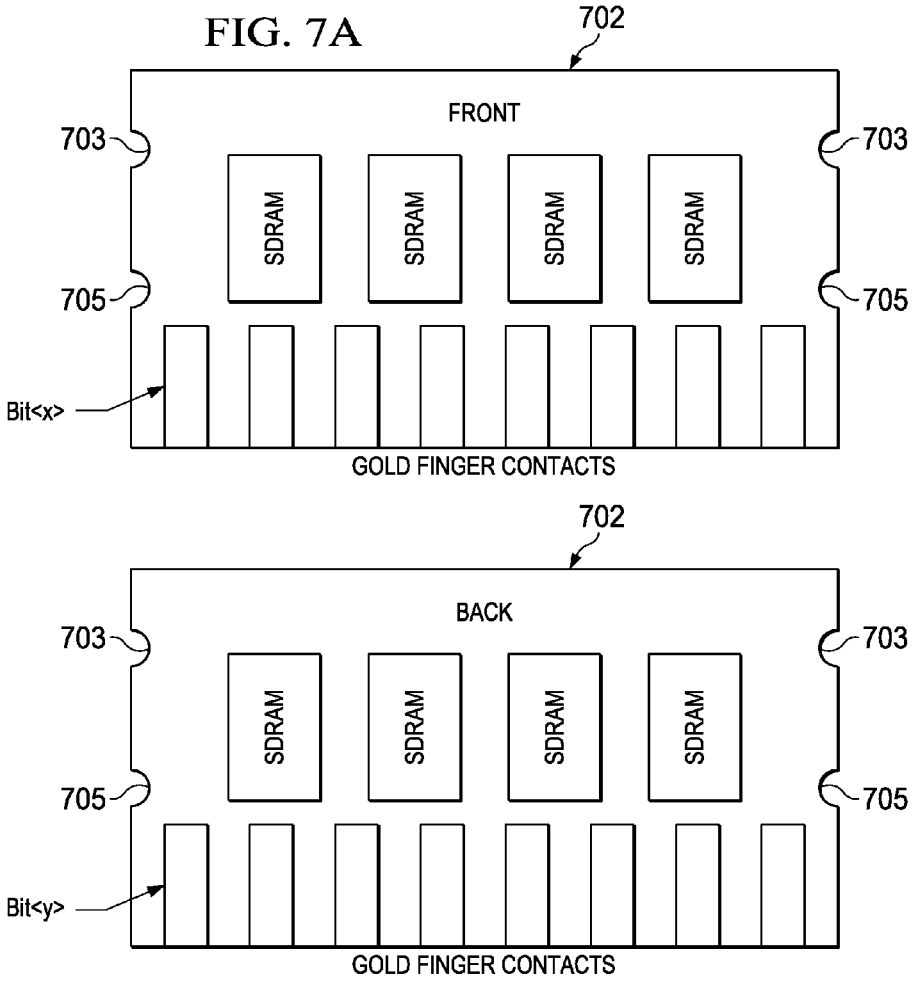
FIG. 7A depicts a front and back view of a dual in-line design.
Figure 7B:
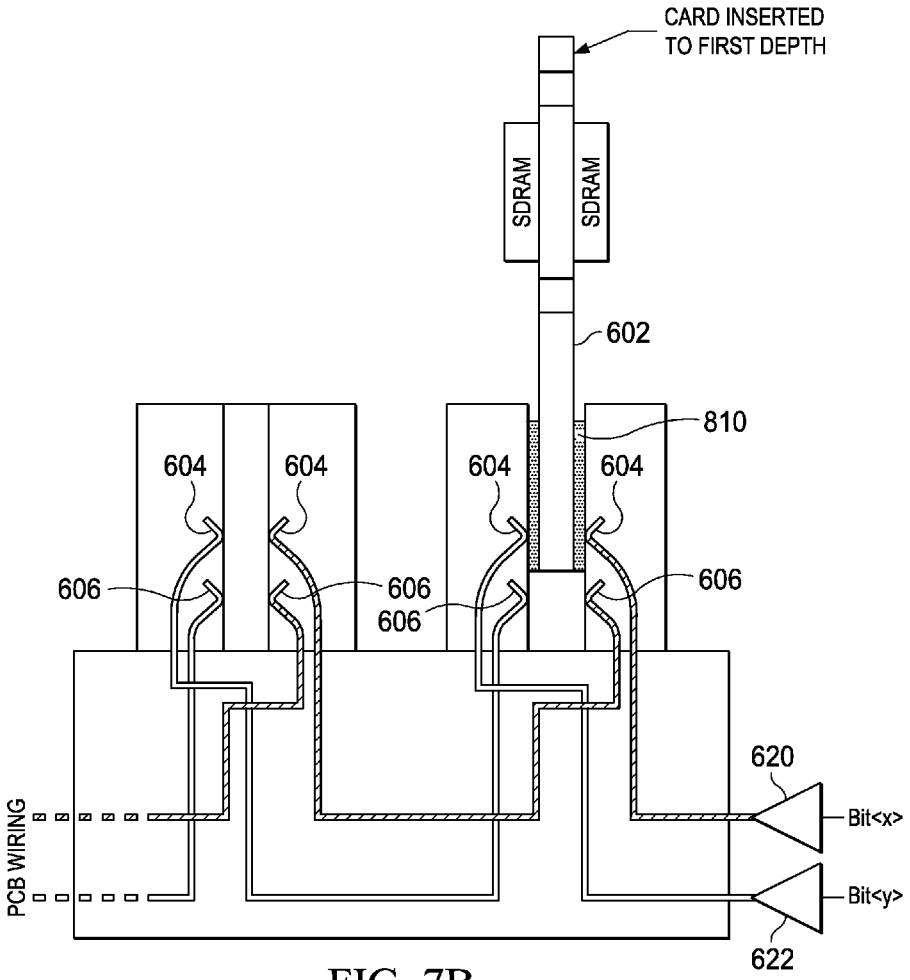
FIG. 7B depicts a side view of a dual in-line design with cards mounted in connectors at different depths.
Figure 7C:
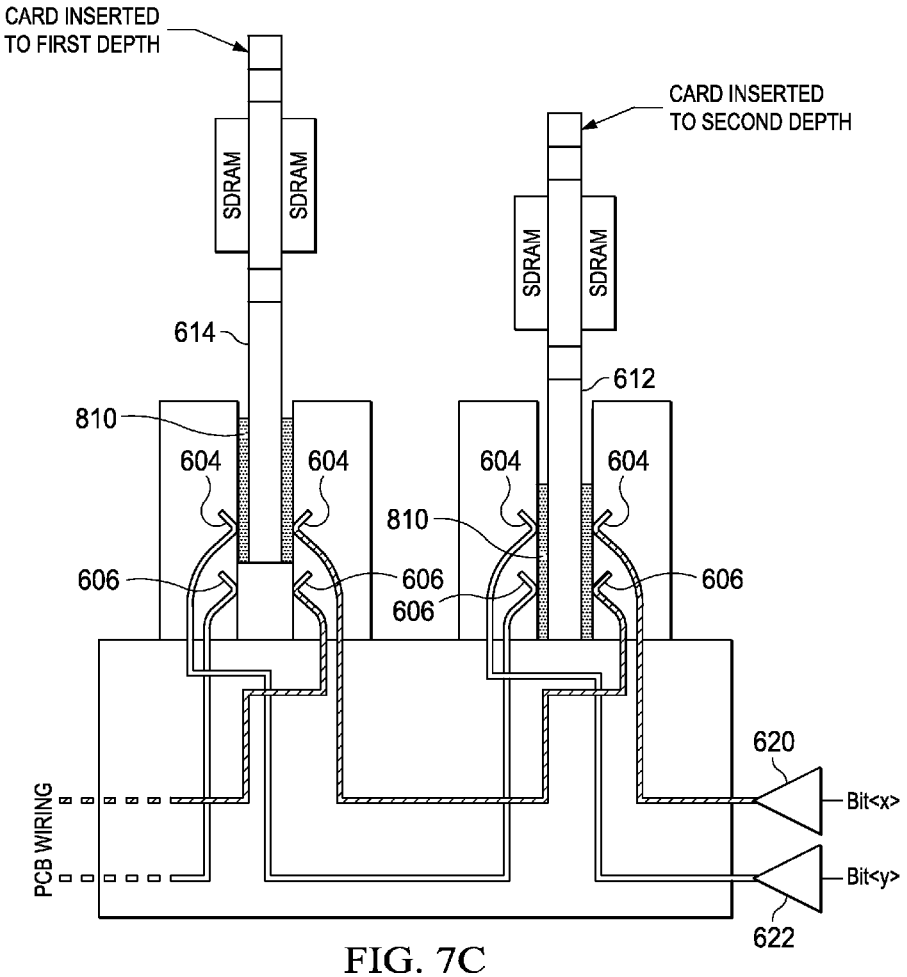
FIG. 7C depicts another side view of a dual in-line design with cards mounted in connectors at different depths.

Turning now to FIGS. 7A-7C, there is shown a front view and back view in FIG. 7A, and corresponding side views in FIGS. 7B and 7C, of a representative dual in-line design of a DIMM memory module 702 containing a plurality of SDRAM memory modules on both sides of the DIMM memory module and associated finger contacts (preferably gold contacts, but another conductive material such as copper could also be used for the finger contacts) used to connect the DIMM module to a DIMM connector, where the above describe multi-level connectivity is provided for signals on both sides of the DIMM module. Alternatively, the Bit<x> bus signals could be provided on the back side of the DIMM module, and the Bit<y> bus signals could be provided on the front side of the DIMM module. The techniques described herein are also applicable to other types of electronic modules or cards other than a DIMM module.

Referring specifically to the front and back DIMM module views of FIG. 7A, snap-in depth control slots are shown along the edges of the DIMM module that provide support for snapping the DIMM module into a DIMM connector at either a first level (partially inserted) or a second level (fully inserted), as previously described. Snap-in depth control slots 703 facilitate positioning the DIMM module at a first (partial) level/depth within a DIMM connector, and snap-in depth control slots 705 facilitate positioning the DIMM module at a second (full) level/depth within a DIMM connector. The depth control function of either slot could be interchanged. An alternate means of controlling the depth could be achieved by another method such as an insert that is placed in the socket prior to inserting the card which prevents the card from being inserted to the second level. Another method may use a pin that could be inserted through a hole or notch that limits the travel of the module and prevents it from being inserted to the second level. These two sets of slots are operable to mate with one of two corresponding protruding portions (FIG. 8 elements 806 and 808, respectively) of a DIMM connector that the DIMM module is inserted into, as further shown below with respect to the FIG. 8 description.

Referring specifically to a representative side view shown in FIG. 7B, where the depicted view is similar to the near-populated configuration shown in FIG. 6A, but with multi-level connections being provided on both sides of the DIMM card. Here, a single card is shown that is inserted to a first level or depth in a given connector such that the wiring for the second connector is electrically isolated from the wiring of the first connector in similar fashion to that described above with respect to FIG. 6A.

The depicted view in FIG. 7C is similar to the two-DIMM populated configuration shown in FIG. 6B, but with multi-level connections being provided on both sides of the DIMM card. Here, two cards are shown that are inserted into respective DIMM connectors, where DIMM card 612 is fully inserted at a second depth or level and DIMM card 614 is partially inserted at a first depth or level such that the wiring for the second connector is electrically connected to the wiring of the first connector in similar fashion to that described above with respect to FIG. 6B. Here, representative bus Bit(x) and Bit (y) are shown being sourced from a controller driver/receiver (not shown), and following internal printed circuit board wiring to the two connector pins 604 associated with the card inserted to the second depth. Shunts 810 each provide an electrical path—since the card is fully inserted to the second depth—between pins 604 and 606 on each side of the card, to thus provide an electrical connection from each of pins 606 back down to the printed circuit board wiring that provides an electrical path to each of pins 604 on the next connector in the serially cascaded set of connectors. While only two bits are shown for ease of clarity, there are numerous bits so configured to provide a fully functional bus that is driven by a controller driver/receiver, as will now be shown.

Figure 7D:
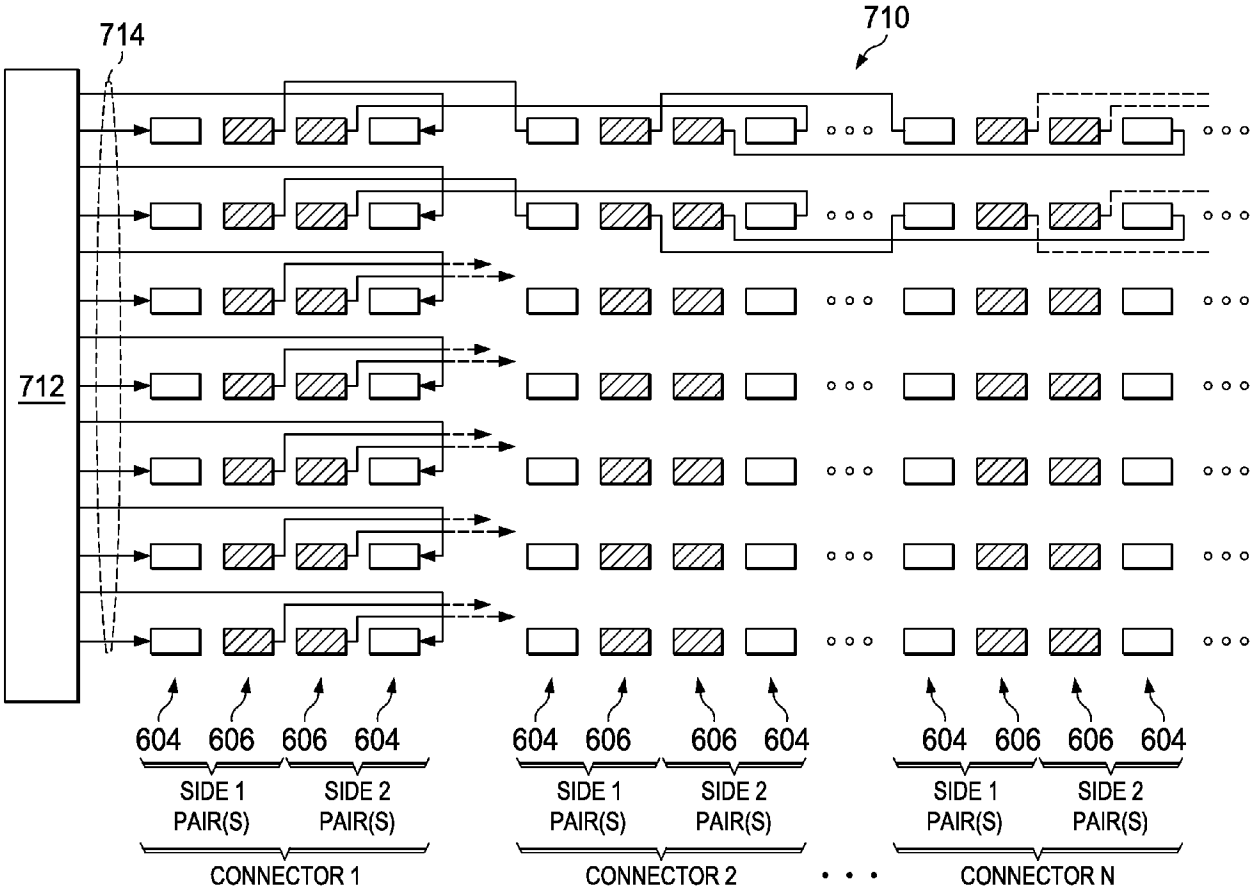
FIG. 7D depicts logical wiring between connector pins for multiple connectors in a first shunting embodiment.

FIG. 7D element 710 depicts a conceptual view of multiple connector pin pairs for a given connector, and the logical wiring between pads of multiple connectors connected in a serially cascaded fashion. The rectangular pads for the connectors are electrically connected to associated connector pins 604 and 606 (not shown, except for the pin numbers along the bottom of the Figure that the respective pads are associated with). Here, a controller 712 reads/writes to the bus 714, and such signal travels along internal wiring to the first set of pins 604 of a pin pair 604/606 for both side 1 and side 2 of connector 1. Each of pins 606 of a pin pair 604/606 for both side 1 and side 2 of connector 1 are then electrically connected to respective pins 604 of a pin pair 604/606 for both side 1 and side 2 of connector 2, where connector 2 is configured the same as connector 1 in order to provide card insertion-level based selective electrical connectivity or isolation to another downstream connector, as previously described.

Figure 8A:
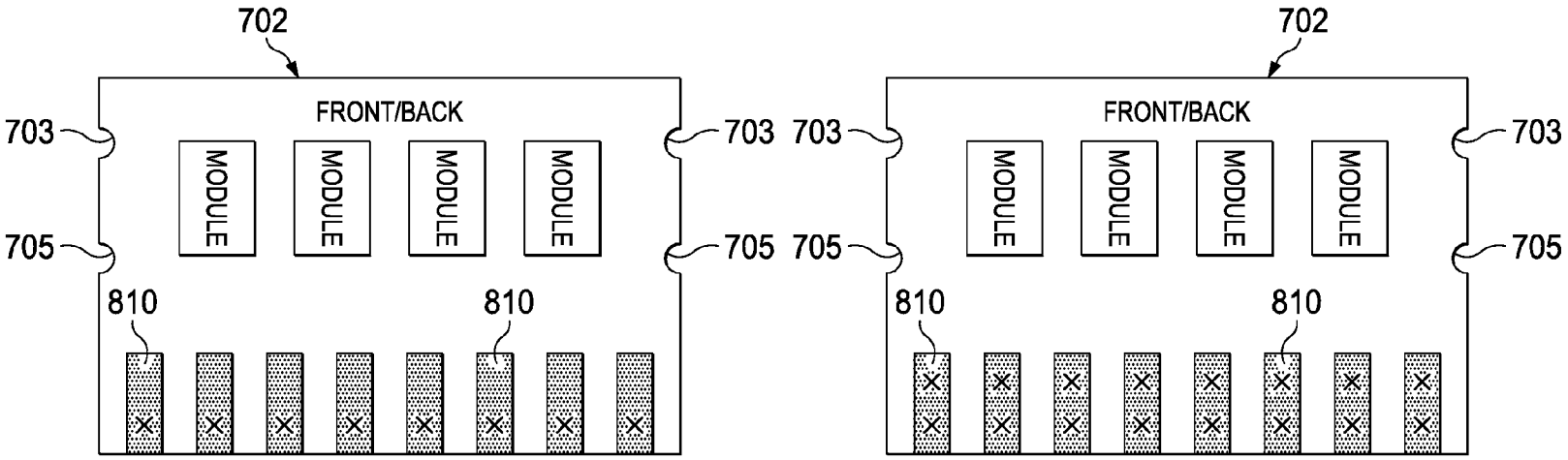
FIG. 8 (including FIGS. 8A and 8B) depicts a positioning and latching arrangement that provides multiple levels or depths for a card or module installed in a connector.
Figure 8B:
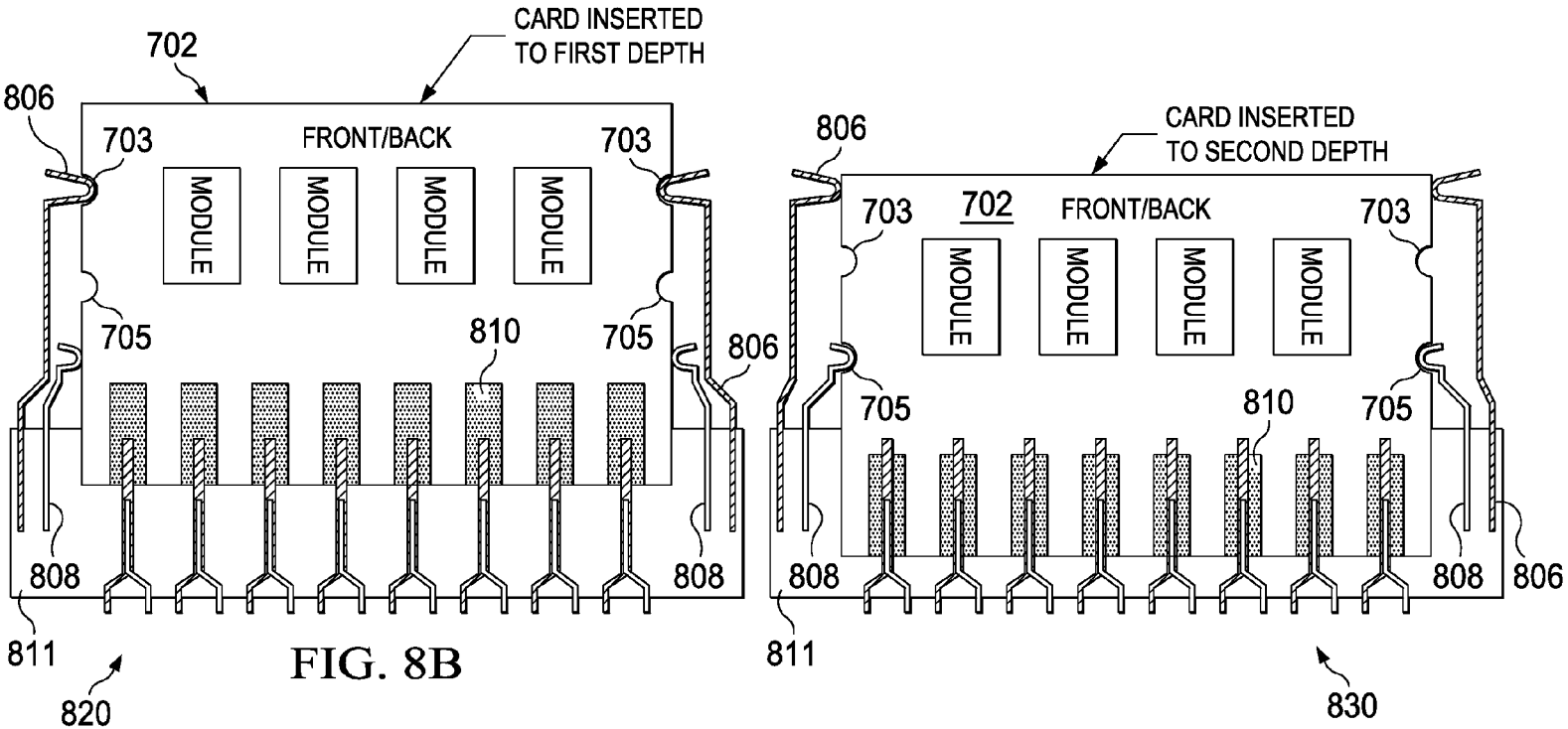

FIG. 8 (including FIGS. 8A and 8B) depicts details of the dual-level retainer portion of a connector that is operable for providing two depths or levels for inserting a card or module therein. Snap-in slots 703 for the deep (fully inserted, second) depth and snap-in slots 705 for the shallow (partially inserted, first) depth are depicted along the side of DIMM card/module 702. When a card is partially inserted and snapped into the slots 705 as shown on the left of FIG. 8B, contacts of long pins are made on Gold fingers 810 along the bottom portion of such Gold fingers along both the front side and back side as marked with 'x's on the left side of FIG. 8A. When a card is fully inserted in the connector at the second depth/level to provide the electrical connectivity to a subsequent connector in a serially cascaded bus connection, as previously described, two rows of contacts are made as marked with 'x' along the bottom and the upper parts of the Gold fingers 810 as shown on the right of FIG. 8A, providing a short between short and long pins such as is shown by elements 604 and 606 of FIGS. 6 and 7.

As shown at 820 of FIG. 8B, DIMM module/card 702 is inserted to a first level or depth in DIMM connector 811. A spring clip 806 of DIMM connector 811 engages with the first level snap-in depth control slot 703 to position the DIMM module/card 702 at a first depth/level. As shown at 830 of FIG. 8B, DIMM module/card 702 is inserted to a second level or depth in DIMM connector 811. A spring clip 808 of DIMM connector 811 engages with the second level snap-in depth control slot 705 to position the DIMM module/card 702 at a second depth/level.

Figure 9A:
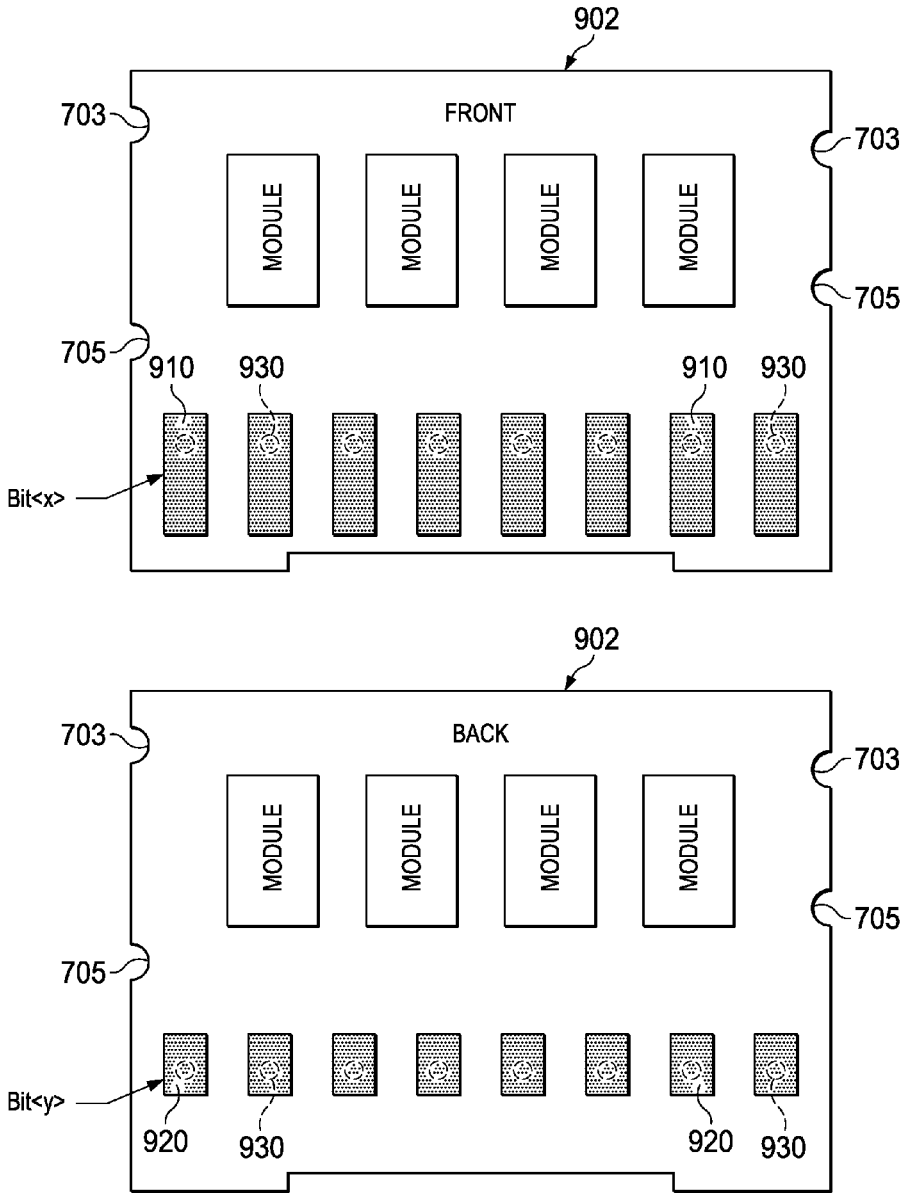
FIG. 9A depicts a front and back view of an alternative dual in-line design.
Figure 9B:
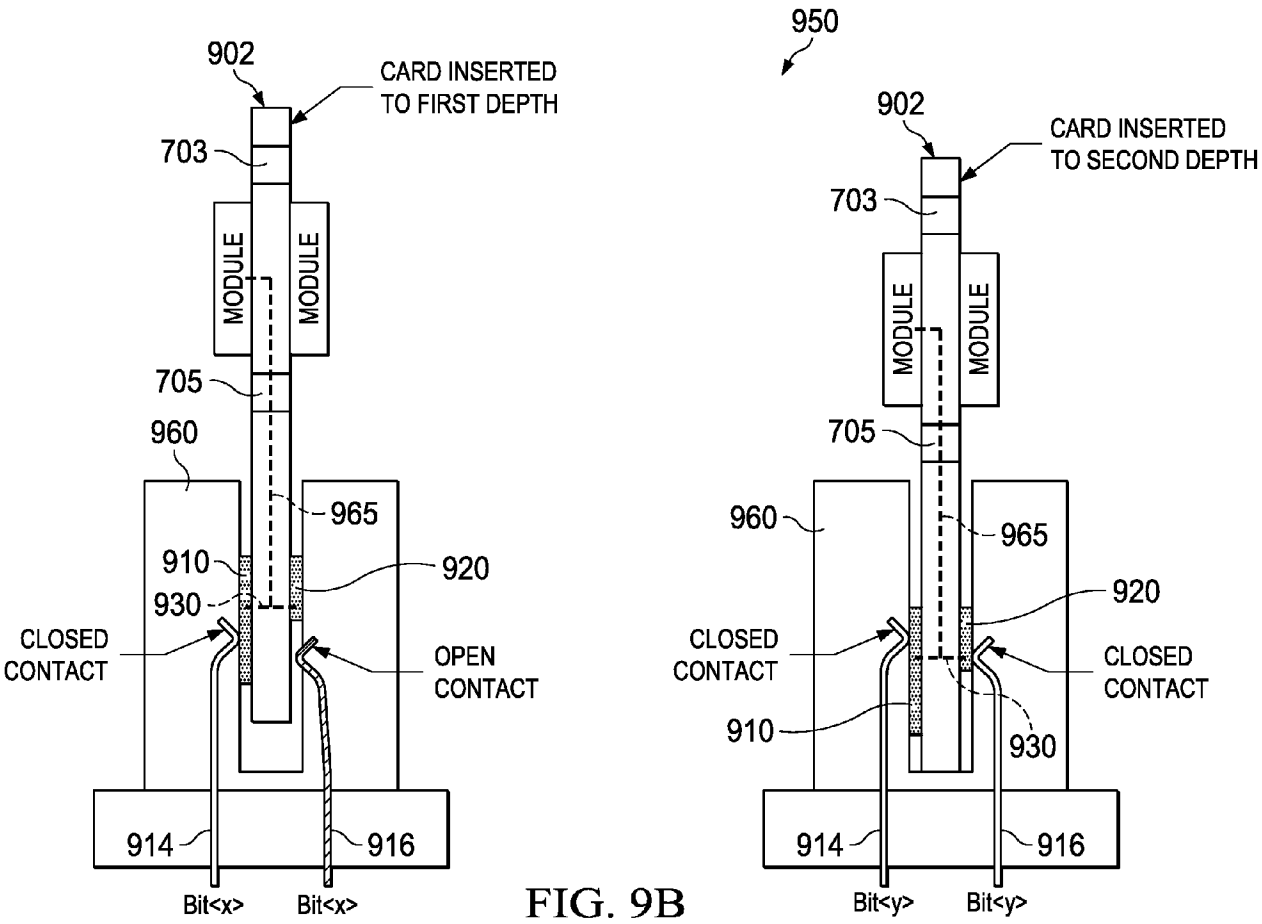
FIG. 9B depicts a side views of the alternative dual in-line design of FIG. 9A with a single-contact approach in a shunting environment with finger contact through-vias.

FIGS. 9A and 9B depict an alternative embodiment where extra-long contacts 910 are provided along the bottom edge on the front side of DIMM module/card 902 (per FIG. 9A), and shorter (normal) length contacts 920 are provided along the bottom edge on the back side of DIMM module/card 902 (per FIG. 9A). Of course, the front and back sides could be reversed or switched, where the front side has the shorter length contacts and the back side has the extra-long contacts.

In this embodiment shown in FIG. 9A, a set of through-vias 930 are provided to interconnect the extra-long contacts 910 on the front side of DIMM module/card 902 to the shorter/normal length contacts 920 on the back side of DIMM module/card 902 (as can further be seen by the side views in FIG. 9B). In this configuration, the spring clips within the DIMM connector can be shaped/sized different than previously shown by elements 604 and 606 in FIGS. 7B and 7C. In this shunting embodiment, as contrasted to the embodiment shown in FIGS. 7B and 7C, the set of through-vias 930 provide electrical connection from a front side connector pin to an associated back side connector pin for a given card. Thus, the shape/size of the spring clips used in this embodiment can be different than previously shown by elements 604 and 606 in FIGS. 7B and 7C, since a connection is provided from the front to the back side of the card using such through-vias 930, as will now be shown.

For example, as shown by the configuration 950 with its associated DIMM connector 960 in FIG. 9B, spring clip 914 includes a single v-shaped protrusion for engaging with the DIMM module/card, and spring clip 916 similar includes a single v-shaped protrusion for engaging with the DIMM module card 902. This single-contact implementation 950 of FIG. 9B also shows an example of the DIMM module/card inserted in both a first and second depth. The first (partial) depth card insertion is shown by the left-side of configuration 950, resulting in a closed contact on one side of the DIMM card 902 and an open contact on the other side of the DIMM card 902 and thus providing electrical isolation with associated stub removal. The second (full) depth card insertion is shown by the right-side of configuration 950, resulting in a closed contact on both sides of the DIMM card 902 and thus providing electrical continuity to the next DIMM connector in the serial daisy chain but. Also shown is a representative bus bit connection 965 between a given bus signal on a daughter card and a module mounted on such daughter card, thus depicting a complete bus signal path from printed circuit board wiring to a connector that a daughter card is plugged into for electrical interconnect there between, and then from the daughter card to a module mounted on such daughter card.

Figure 10:
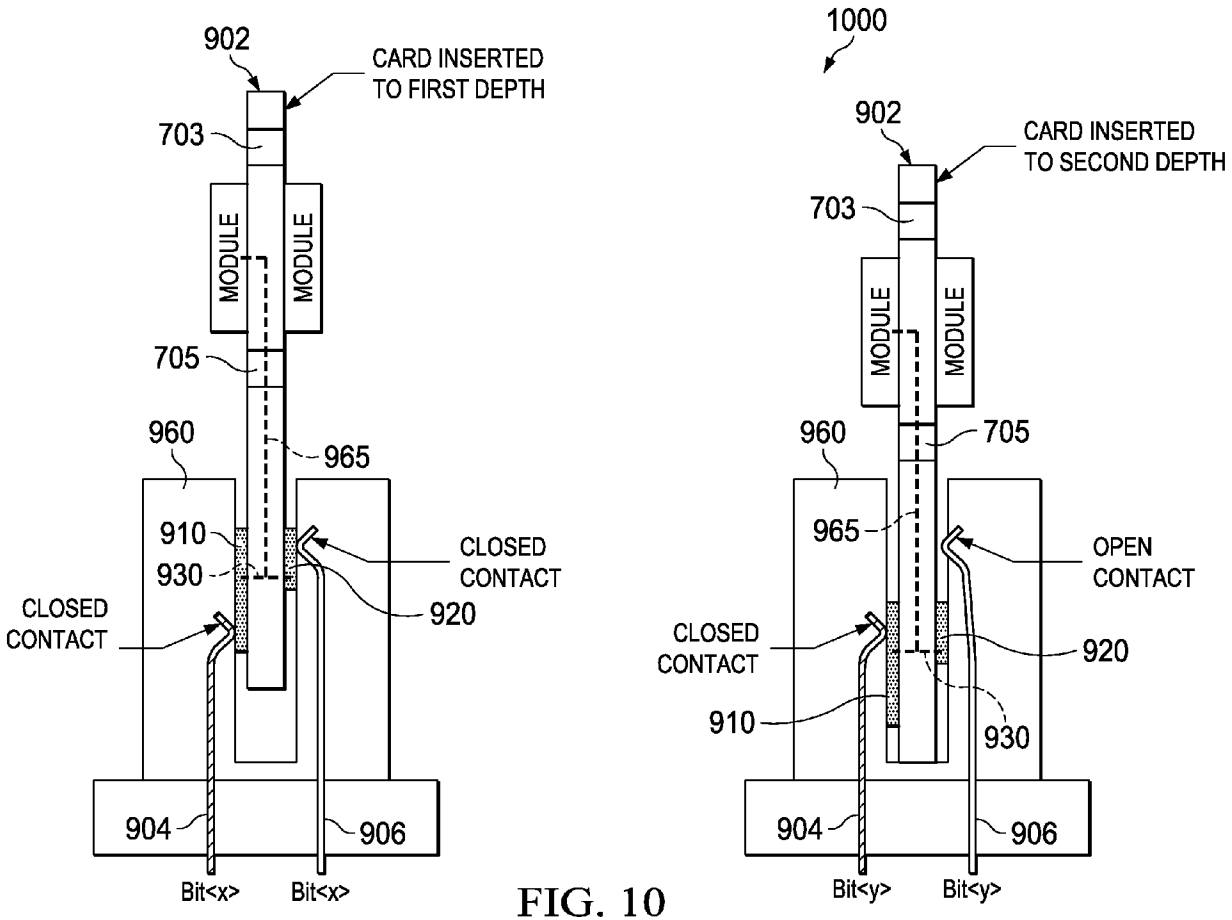
FIG. 10 depicts an alternative embodiment where the first/partial level/depth provides a shunting/closed contact for electrical connection to other connectors, and the second/full level/depth provides no contact—and thus provides electrical isolation—to other connectors to thereby mitigate undesired signal reflections.

Turning now to FIG. 10, an alternative embodiment is shown where the first/partial level/depth provides a shunting/closed contact for electrical connection to other connectors, and the second (full) level (depth) provides no contact—and thus provides electrical isolation—to other connectors to thereby mitigate undesired signal reflections.

As shown by the configuration at 1000 with its associated DIMM connector 960 in FIG. 10, spring clip 904 includes a v-shaped protrusion for engaging with the DIMM module/card, and spring clip 906 also includes a v-shaped protrusion for engaging with the DIMM module card 902, but the contact point has been extended upward/higher than the previously described embodiments. This configuration at 1000 of FIG. 10 shows an example of the DIMM module/card inserted in both a first and second depth, but with the connection/isolation functionality being reversed from what was previously described in earlier embodiments. The first (partial) depth card insertion is shown by the left-side of configuration 940, resulting in a closed contact on both sides of the DIMM card 902 and thus providing electrical continuity to the next DIMM connector in the serial daisy chain. The second (full) depth card insertion is shown by the right-side of configuration 940, resulting in a closed contact on both sides of the DIMM card 902 and thus providing electrical isolation with associated stub removal in this alternative embodiment.

Thus, illustrative embodiments of the present invention provide a computer implemented method and computer system for providing an improved connector for connecting bus lines to a card such as a memory card or media card. In particular, a multi-level connector comprising a latching device having a plurality of insertable latch positions is provided and described herewith.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiment. For example, back-drilling vias at the connector pins could further minimize the effect of those vias stubs on the printed-circuit card. The terminology used herein was chosen to best explain the principles of the embodiment, the practical application or technical improvement over technologies found in the marketplace, or to enable others of ordinary skill in the art to understand the embodiments disclosed here.

The flowchart and block diagrams in the Figures illustrate the architecture, functionality, and operation of possible implementations of systems and methods according to various embodiments of the present invention. It should also be noted that, in some alternative implementations, the functions noted in the block may occur out of the order noted in the figures. For example, two blocks shown in succession may, in fact, occur substantially concurrently, or the blocks may occur in the reverse order, depending upon the functionality involved.

What is claimed is:

1. An apparatus comprising a multi-level connector configured to receive a board having one or more electrical components attached thereto, wherein the multi-level connector comprises a latching device having a plurality of board-insertable latch positions at different physical levels within the multi-level connector, wherein each of the latch positions are configured to selectively provide an electrical connection between an electrical contact portion of the multi-level connector and a pin portion of the multi-level connector based on how deep the board is plugged into the multi-level connector.

2. The apparatus of claim 1, wherein the multi-level connector is a multi-level board connector that has a board inserted therein.

3. An electronic package, comprising:

a printed circuit board;

a plurality of board connectors attached to the printed circuit board, with at least one board connector of the plurality of board connectors having at least two different board-mount levels that a board can be positioned within the at least one board connector; and a daughter board plugged into the at least one board connector, wherein the daughter board is a first daughter board and the at least one board connector is a first board connector of the plurality of board connectors, and the first daughter board is plugged into the first board connector at a first level of the at least two different board-mount levels of the first board connector, and further comprising:

a second daughter board plugged into a second board connector of the plurality of board connectors at a second level of the at least two different board-mount levels of the second board connector, and wherein the first level and the second level are at a same physical level, and further comprising:

a third daughter board plugged into a third board connector of the plurality of board connectors at a third level of the at least two different board-mount levels of the third board connector, wherein the second level is a different physical level than the third level.

4. The electronic package of claim 3, wherein there are a plurality of pairs of contact pins configured as the pair of contact pins and a plurality of second pairs of contact pins configured as the second pair of contact pins, and wherein the first daughter board provides an electrical conductive path between each respective pair of the plurality of pairs of contact pins when plugged into the first board connector at the first level and the second daughter board provides a second electrical conductive path between each respective second pair of the plurality of second pairs when plugged into the second board connector at the second level.

5. An apparatus comprising a multi-level connector comprising a latching device having a plurality of board-insertable latch positions at different physical levels within the multi-level connector, wherein the multi-level connector is a multi-level board connector that has a board inserted therein, and wherein the board provides an electrical path between each pair of a plurality of pairs of contact pins of the multi-level connector when the board is inserted at a first latch level of the multi-level connector, and the board provides electrical isolation between the each pair of the plurality of pairs of contact pins of the multi-level connector when the board is inserted at a second latch level of the multi-level connector that is different than the first latch level.

6. The apparatus of claim 5, wherein the board is a daughter card and the multi-level connector has a plurality of fixed stops that provide the plurality of board-insertable latch positions.

7. The apparatus of claim 6, wherein the daughter card comprises electronic modules mounted on multiple sides of the daughter card.

8. The apparatus of claim 7, where the daughter card has relatively long contacts along a first edge of a first side of the daughter card, and has relatively short contacts along a second edge of a second side of the daughter card.

9. The apparatus of claim 5, wherein multiple ones of the multi-level connector are mounted on a system board that includes wiring for interconnecting the multiple ones of the multi-level connector together.

10. The apparatus of claim 1, wherein multiple ones of the multi-level connector are mounted on a system board that includes wiring for interconnecting the multiple ones of the multi-level connector together, wherein a first board is inserted into a first one of the multiple ones of the multi-level connector at a first level and a second board is inserted into a second one of the multiple ones of the multi-level connector at a second level that is a different level than the first level.

11. An electronic package, comprising:

a printed circuit board;

a plurality of board connectors attached to the printed circuit board, with at least one board connector of the plurality of board connectors having at least two different board-mount depth levels that a board can be positioned within a given slot of the at least one board connector; and a daughter board plugged into the at least one board connector, wherein the at least one board connector is configured to selectively provide an electrical connection between an electrical contact portion of the at least one board connector and the printed circuit board based on how deep the daughter board is plugged into the at least one board connector.

12. The electronic package of claim 11, wherein the daughter board is a first daughter board and the at least one board connector is a first board connector of the plurality of board connectors, and the first daughter board is plugged into the first board connector at a first level of the at least two different board-mount levels of the first board connector, and further comprising:

a second daughter board plugged into a second board connector of the plurality of board connectors at a second level of the at least two different board-mount levels of the second board connector, wherein the first level and the second level are at different depth levels with respect to one another.

13. An electronic package, comprising:

a printed circuit board;

a plurality of board connectors attached to the printed circuit board, with at least one board connector of the plurality of board connectors having at least two different board-mount levels that a board can be positioned within the at least one board connector; and a daughter board plugged into the at least one board connector, wherein the daughter board is a first daughter board and the at least one board connector is a first board connector of the plurality of board connectors, and the first daughter board is plugged into the first board connector at a first level of the at least two different board-mount levels of the first board connector, and further comprising:

a second daughter board plugged into a second board connector of the plurality of board connectors at a second level of the at least two different board-mount levels of the second board connector, and wherein the first level and the second level are different physical levels, and wherein the first board connector includes a pair of contact pins each positioned at a different height within a board-receiving cavity of the first board connector, and wherein the first daughter board provides an electrical conductive path between the pair of conductive strips when plugged into the first board connector at the first level.

14. The electronic package of claim 13, where the electrical conductive path completes a net conductive path for a signal line between the first board connector and the second board connector.

15. The electronic package of claim 14, wherein there are a plurality of pairs of contact pins configured as the pair of contact pins, and wherein the first daughter board provides a conductive path between each respective pair of the plurality of pairs of contact pins when plugged into the first board connector at the first level.

16. The electronic package of claim 13, wherein the second board connector includes a second pair of contact pins each positioned at a different height within a second board-receiving cavity of the second board connector, and wherein the second daughter board provides an electrical isolation between the second pair of conductive strips when plugged into the second board connector at the second level.

17. The electronic package of claim 16, wherein there are a plurality of second pairs of contact pins configured as the second pair of contact pins, and wherein the second daughter board provides an electrical isolation between each respective second pair of the plurality of second pairs of contact pins when plugged into the second board connector at the second level.

18. The electronic package of claim 3, wherein the first board connector includes a pair of contact pins each positioned at a different height within a board-receiving cavity of the first board connector, wherein the second board connector includes a second pair of contact pins each positioned at a different height within a second board-receiving cavity of the second board connector, and wherein the first daughter board provides an electrical conductive path between the pair of conductive strips when plugged into the first board connector at the first level and the second daughter board provides a second electrical conductive path between the second pair of conductive strips when plugged into the second board connector at the second level.

19. The electronic package of claim 18, where the electrical conductive path and second electrical conductive path completes a net conductive path for a signal line between the first board connector, the second board connector and the third board connector.

* * * * *